United States Patent [19]

Cunning

[11] 4,272,370

[45] Jun. 9, 1981

[54] GUTTER STRAINER

[75] Inventor: Joseph M. Cunning, Cohasset, Mass.

[73] Assignee: Bird & Son, Inc., East Walpole, Mass.

[21] Appl. No.: 137,772

[22] Filed: Apr. 7, 1980

[51] Int. Cl.[3] ..... B01D 35/02

[52] U.S. Cl. ..... 210/162; 210/163; 210/455; 52/12

[58] Field of Search ..... 210/162, 163, 164, 165, 210/166, 459, 455, 473, 475; 52/13

[56] References Cited

U.S. PATENT DOCUMENTS

| | | | |
|---|---|---|---|
| 233,677 | 10/1880 | Hess | 52/12 |
| 355,330 | 1/1887 | Locke | 210/163 |
| 803,316 | 10/1905 | Vogel | 210/162 |
| 891,405 | 6/1908 | Cassens | 52/12 |
| 1,012,764 | 12/1911 | Tassel | 210/162 |
| 1,711,674 | 5/1929 | Egan | 210/103 |
| 2,210,248 | 8/1940 | Lighthill | 210/162 |
| 2,365,845 | 12/1944 | Schweda | 52/12 |
| 2,569,568 | 10/1951 | Lipshaw | 52/12 |
| 2,701,027 | 2/1955 | Scoville | 210/103 |
| 3,703,194 | 11/1972 | Giordano | 210/103 |

*Primary Examiner*—Ernest G. Therkorn

[57] ABSTRACT

A gutter strainer having a central grid portion defining a plurality of openings for impeding passage of debris while allowing passage of water is provided for vertical mounting at any desired position within a gutter of the type having inturned flanges extending continuously along its upper edges.

2 Claims, 5 Drawing Figures

FIG 1
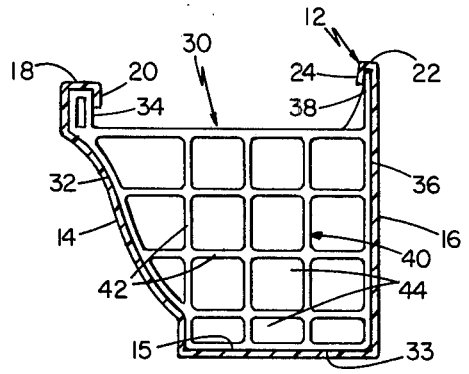
FIG 3
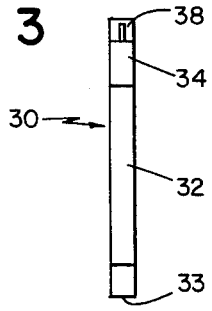
FIG 4
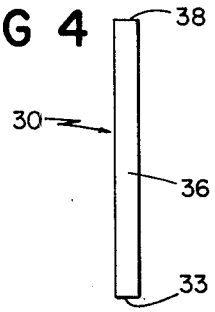
FIG 2
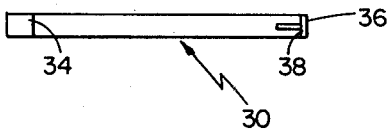
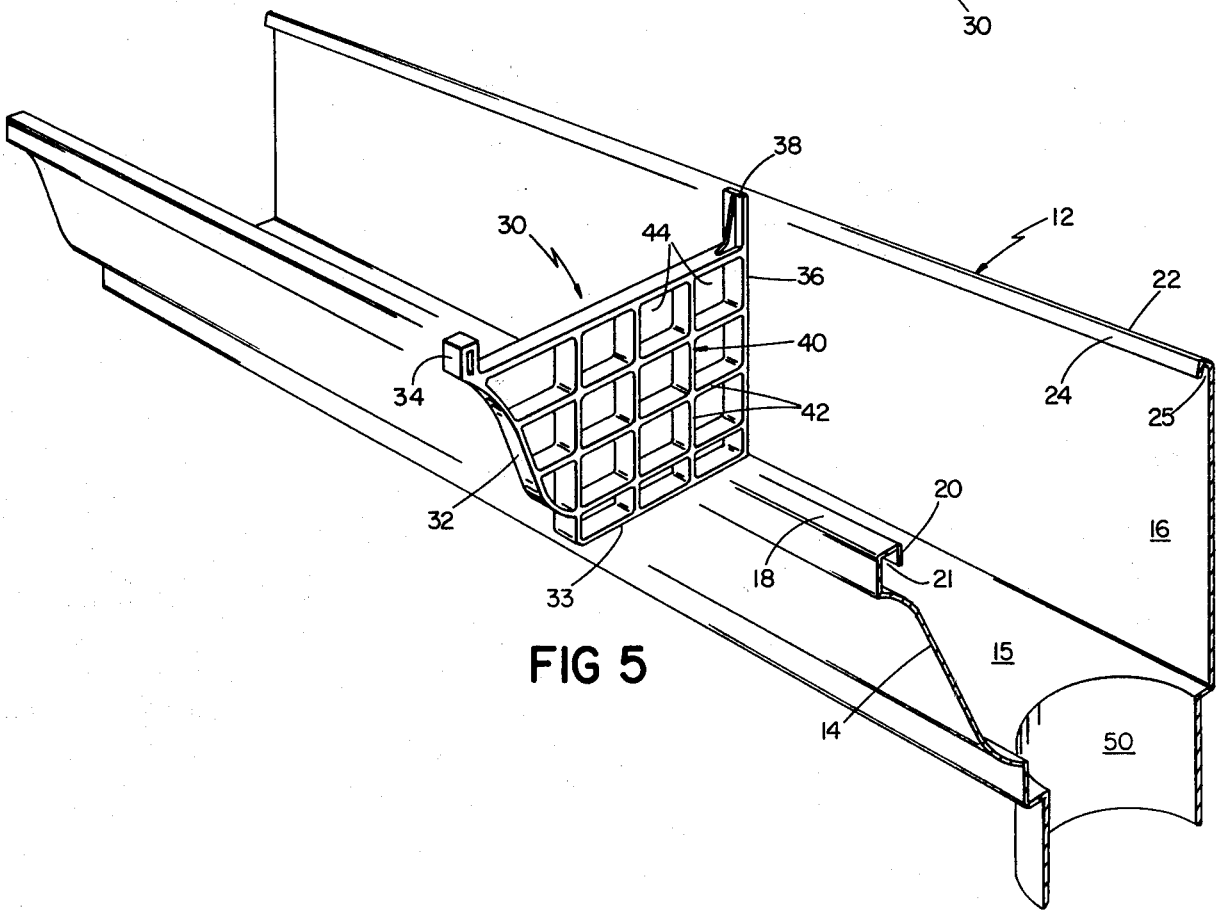
FIG 5

GUTTER STRAINER

This invention relates to gutter strainers adapted for use within metal or plastic house gutters to prevent debris, such as leaves, from clogging the gutters of their downspouts.

In recent years, metal or plastic gutters have found increasing acceptance as a substitute for conventional wooden gutters in house construction, since they are not subject to rot caused by the inevitable presence of moisture and never need painting. Such gutters differ in construction from wood gutters, in that they are of relatively thin material and, accordingly, in order to provide the requisite rigidity, usually have inturned flanges which extend continuously along their top edges, providing opposed open bottomed recesses. These, however, cannot be seen when viewed from beneath after installation on a house, so that such gutters have the same appearance as wooden gutters.

Although such gutters have great advantages over wood gutters, they are, like wood gutters, still subject to the collection of debris, generally in the form of leaves, which are thereafter floated along the gutter by rainwater and into the downspout. Since this will eventually plug the downspout and prevent its draining water from the gutter, the problem, as with wood gutters, has conventionally been dealt with by placing a piece of screen horizontally in the bottom of the gutter so that it covers the downspout. This, however, is not a satisfactory solution, since the leaves accumulate on top of the screen and plug it, so that the gutter overflows and so must be cleaned. Accordingly, it is a major object of the present invention to provide a novel gutter strainer which can be mounted vertically at any desired position within a gutter spaced from its downspout.

It is another object of the invention to provide a novel gutter strainer which utilizes the construction of a gutter of the type having inturned flanges extending continuously along its upper edges for its mounting and retention within the gutter.

It is still another object of the invention to provide a novel gutter strainer which may be quickly and easily installed at any desired position within a gutter without the use of tools or fasteners.

In order to accomplish these objectives, the present invention provides, for use with a generally U-shaped gutter having a generally curvilineal front wall, a generally straight vertical rear wall and a bottom wall extending therebetween, with the front and rear walls each having inwardly and downwardly turned flanges providing open bottom recesses extending continuously along their upper edges, a rigid, generally planar gutter strainer of generally rectangular configuration adapted for vertical mounting within the gutter perpendicular to its front, rear and bottom walls and extending therebetween throughout the vertical cross sectional area of the gutter.

The gutter strainer of the invention has front, rear and bottom edges adapted to abut the front, rear and bottom walls, respectively, of the gutter and a central grid portion defining a plurality of openings for impeding passage of debris while allowing passage of water therethrough. The front and rear edges of the novel gutter strainer each have an upstanding abutment on their upper ends adapted to be received within the front and rear wall flanges, respectively, of the gutter for mounting and retaining the gutter strainer within the gutter perpendicular to its walls. As so mounted, the central grid portion is effective to impede passage of debris along the gutter while allowing water to flow therethrough.

In preferred embodiments, the central grid portion of the novel gutter strainer of the invention consists of a plurality of horizontal and vertical right angle elements defining a plurality of rectangular openings, the dimension of such elements in the direction perpendicular to the plane of the gutter strainer being substantially greater than their dimension in the direction parallel to such plane.

Other objects, features, and advantages of the present invention will appear from the following detailed description of a preferred embodiment thereof, taken together with the accompanying drawing, wherein:

FIG. 1 is side view of the gutter strainer of the invention shown mounted within a gutter;

FIG. 2 is a top view of the gutter strainer of FIG. 1;

FIGS. 3 and 4 are opposite side views of the gutter strainer of FIGS. 1 and 2; and FIG. 5 is a perspective view of the gutter strainer of FIGS. 1 through 5 shown mounted within a gutter.

Referring to the drawings, the rigid, generally planar gutter strainer of generally rectangular configuration of the invention, generally designated 30, is fitted within a generally U-shaped gutter, generally designated 12.

More specifically, the generally U-shaped gutter 12 has a generally curvilineal front wall 14, a generally vertical straight rear wall 16, and a bottom wall 15 extending between front wall 14 and rear wall 16. Extending continuously along the upper edge 18 of front wall 14 is an inwardly and downwardly turned flange 20 that provides an open bottom recess 21 having a generally rectangular shape. A similar inwardly and downwardly turned flange 24, also providing an open bottom recess 25, extends continuously along the upper edge 22 of rear wall 16.

The novel gutter strainer 30 of the present invention is vertically mounted anywhere within gutter 12 perpendicular to front wall 14, rear wall 16 and bottom wall 15 and extends between these walls throughout the vertical cross sectional area of gutter 12.

More specifically, gutter strainer 30 has a generally curvilineal front edge 32, a generally straight vertical rear edge 36 and a bottom edge 33 for abutting the front wall 14, rear wall 16 and bottom wall 15, respectively, of gutter 12. Front edge 32 includes a generally rectangular upstanding abutment 34 on its upper end which is adapted to be received within the rectangular-shaped, open bottom recess 21 of front wall 14 for retaining gutter strainer 30 in its perpendicular position. A similar upstanding abutment 38, at the upper end of rear edge 36, is adapted for mounting within the open bottom recess 25 of rear wall 16 of gutter 12.

Gutter strainer 30 further includes a central grid portion 40 which consists of a plurality of horizontal and vertical right angle elements 42 that define a plurality of rectangular openings 44. These rectangular openings 44 impede the passage of debris while allowing the passage of water through gutter strainer 30. The dimension of the right angle elements 42 in the direction perpendicular to the plane of gutter strainer 30 is preferably substantially greater than their dimension in the direction parallel to such plane for maximum open area and rigidity of gutter strainer 30.

Although it is preferred that the gutter strainer of the invention be integrally molded or extruded of plastic or metal, it is also contemplated that it may be stamped from metal or plastic sheet material or fabricated from individual metal or plastic parts.

In operation, the novel rigid, generally planar gutter strainer 30 can be vertically mounted anywhere in gutter 12, especially near a downspout 50 where debris buildup is most prevalent, to prevent leaves from clogging the downspout. Thus, gutter strainer 30 is mounted within gutter 12 perpendicular to its front wall 14, rear wall 16 and bottom wall 15 with its generally curvilinear front edge 32, the generally straight vertical rear edge 36 and bottom edge 33 abutting the front wall 14, rear wall 16 and bottom wall 15, respectively, of gutter 12.

To retain gutter strainer 30 in its perpendicular position, the rectangular-shaped front edge upstanding abutment 34 is fitted first into the rectangular-shaped, front side open bottom recess 21, and then the rear edge upstanding abutment 38 is fitted within the rear side open bottom recess 25. The gutter strainer 30 is held in place by either a tight friction fit or a small amount of adhesive. Rectangular openings 44 of gutter strainer 30 impede the passage of debris that float along gutter 12 in order to prevent plugging of downspout 50. There is, however, free passage of water through the rectangular openings 44 where debris will accumulate for easy removal during cleaning of gutter 12.

What is claimed is:

1. For use with a generally U-shaped gutter having a generally curvilineal front wall, a generally straight vertical rear wall and a bottom wall extending therebetween, said front and rear walls each having inwardly and downwardly turned flanges providing open bottom recesses extending continuously along their upper edges a rigid, generally planar gutter strainer of generally rectangular configuration adapted for vertical mounting within said gutter perpendicular to its said front, rear and bottom walls and extending therebetween throughout the vertical cross sectional area of said gutter said gutter strainer having front, rear and bottom edges adapted to abut said front, rear and bottom walls, respectively, of said gutter, and a central grid portion defining a plurality of openings for impeding passage of debris while allowing passage of water therethrough said front and rear edges each having an upstanding abutment on their upper ends adapted to be received within said front and rear wall flanges, respectively, of said gutter for mounting and retaining said gutter strainer within said gutter perpendicular to its walls said central grid portion consisting of a plurality of elements defining said plurality of openings, the dimension of said elements in the direction perpendicular to the plane of said gutter strainer being substantially greater than their dimension in the direction parallel to said plane wherein said central grid portion is effective to impede passage of debris along said gutter while allowing water to flow therethrough.

2. A gutter strainer as claimed in claim 1, wherein said a central grid portion consists of a plurality of horizontal and vertical right angle elements defining a plurality of rectangular openings.

* * * * *